US005178195A

United States Patent [19]

Glaus et al.

[11] Patent Number: 5,178,195

[45] Date of Patent: Jan. 12, 1993

[54] APPARATUS FOR CONNECTING AT LEAST TWO RODS

[75] Inventors: Heinrich Glaus, Niederwangen; Peter Lehmann, Kirchdorf; Hans Joehr, Kehrsatz; René Freiburghaus, Bern, all of Switzerland

[73] Assignee: Styner & Bienz AG, Niederwangen, Switzerland

[21] Appl. No.: 769,490

[22] Filed: Oct. 1, 1991

Related U.S. Application Data

[63] Continuation of Ser. No. 495,918, Mar. 20, 1990, abandoned.

[30] Foreign Application Priority Data

Apr. 7, 1989 [EP] European Pat. Off. ..... 89810268.6

[51] Int. Cl.[5] ..... B21F 7/00

[52] U.S. Cl. ..... 140/119; 29/809; 29/811.2; 29/816; 140/57

[58] Field of Search ..... 29/243.56, 281.5, 739, 29/740, 810, 811.2, 816, 818; 140/119, 93 A, 93 D, 54, 57, 51, 93.6, 113, 115; 227/114

[56] References Cited

U.S. PATENT DOCUMENTS

| | | | |
|---|---|---|---|
| 3,169,559 | 2/1965 | Working | 140/119 |
| 3,786,841 | 1/1974 | Albrecht et al. | 140/93 A X |
| 3,810,495 | 5/1974 | Pack | 140/93 A |
| 4,798,231 | 1/1989 | Glaus et al. | 140/119 |
| 4,947,902 | 8/1990 | Lehmann et al. | 140/119 |

FOREIGN PATENT DOCUMENTS

| | | |
|---|---|---|
| 2458133 | 6/1976 | Fed. Rep. of Germany . |
| 3223090 | 12/1983 | Fed. Rep. of Germany . |
| 714652 | 11/1931 | France . |

*Primary Examiner*—Joseph M. Gorski
*Assistant Examiner*—S. Thomas Hughes
*Attorney, Agent, or Firm*—Marks & Murase

[57] ABSTRACT

An apparatus for connecting at least two rods by a wire clamp comprises, mounted on one housing portion, a movable handle portion for the advance of said wire clamp, and closing jaws which are adapted to bring the locking portions of the wire clamp into engagement beneath the rods to be connected, and in the other housing portion, a binding hook fitted on a knurled rod, in order to twist the closed loop of the wire clamp which is situated above the rods to be connected. A sliding plate, which is connected to the handle, comprises a mechanism directed to actuating a bending pin on one of the closing jaws, in order to provide for positive interlocking of the wire clamp, and a mechanism for controlling and achieving safe individualization and advance of the wire clamps. Such an apparatus is adapted for reliable, swift and relatively comfortable operation even when exposed to the rough handling on a construction site.

26 Claims, 9 Drawing Sheets

APPARATUS FOR CONNECTING AT LEAST TWO RODS

This application is a continuation of application Ser. No. 07/495,918 filed Mar. 20, 1990, now abandoned.

BACKGROUND OF THE INVENTION

The present invention refers to an apparatus for connecting at least two rods, having a movable handle part for the advance of a wire clamp, and closing jaws which are adapted to bring the locking means of said wire clamp into engagement underneath the rods to be connected; the apparatus further has grabbing means adapted to twist the closed loop portion of the wire clamp situated above the rods to be connected, and one of said two closing jaws has a means for securing the engagement of said locking means by moving one shank of said wire clamp away from the other as soon as its locking means are engaged. Such an apparatus is known from WO 87/01753 of the applicants, and it is generally used for fastening reinforcing rods when erecting reinforced concrete constructions, the reinforcing rods usually lying one above the other in an orthogonal manner and being interconnected at their points of intersection. Moreover, a method for connecting at least two rods is explained in detail in that publication, wherein a wire clamp having locking means at the ends of its shanks is placed around the rods to be connected in such a manner that, as seen from the grabbing member, the locking means are brought into engagement with one another behind said rods, and wherein the closed wire clamp is seized by the grabbing means of the binding apparatus in front of the rods and twisted during a pulling movement.

OBJECTS OF THE INVENTION

Thorough field tests have now shown that one of the embodiments disclosed in the publication is particularly appropriate and can be further improved.

Therefore, it is the object of the present invention to provide an apparatus as mentioned above, which allows reliable and swift work even under the roughest conditions on a construction site. Such an apparatus features a sliding plate connected to the handle, said sliding plate being provided with means directed to controlling and effecting actuation of said securing means of said closing jaw as well as individualisation and advance of said wire clamps. In a preferred embodiment, a self-releasing binding hook as described in European Patent Publication no. 343 309 is used.

BRIEF DESCRIPTION OF THE DRAWINGS

The invention is hereinafter explained in more detail with reference to a drawing of an embodiment.

DETAILED DESCRIPTION OF THE EMBODIMENT

Figure 1:
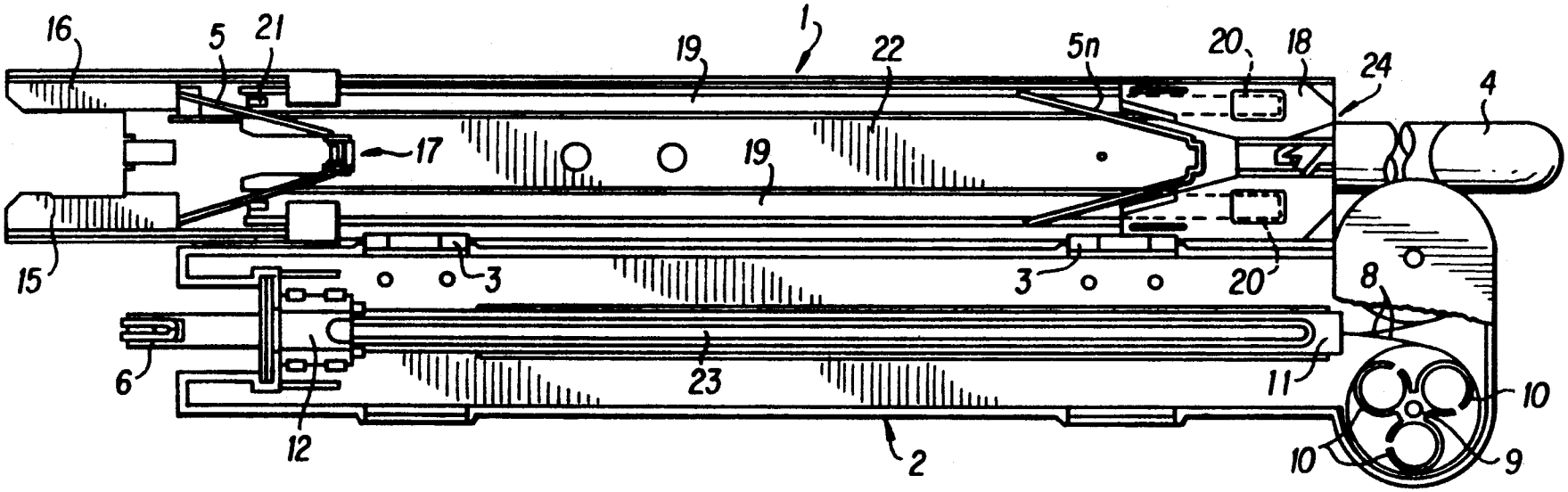
FIG. 1 shows a top view of the opened apparatus of the invention.

The apparatus according to FIG. 1 is arranged in two housing portions 1 and 2 which are connected by means of hinges 3. The discharge and individualisation mechanism, which is operated by handle 4 and by which the wire clamp 5 is placed around the rods to be connected from above and brought into engagement underneath the rods, is arranged in housing portion 1, and the binding hook 6, which is attached to knurled rod 7 and which is inserted into the overhead closed loop portion of the wire clamp and twists it, is disposed in housing portion 2. Interlocking of the wire clamp ends takes place during the advance movement, whereas twisting is effected during the following retraction.

Figure 6:
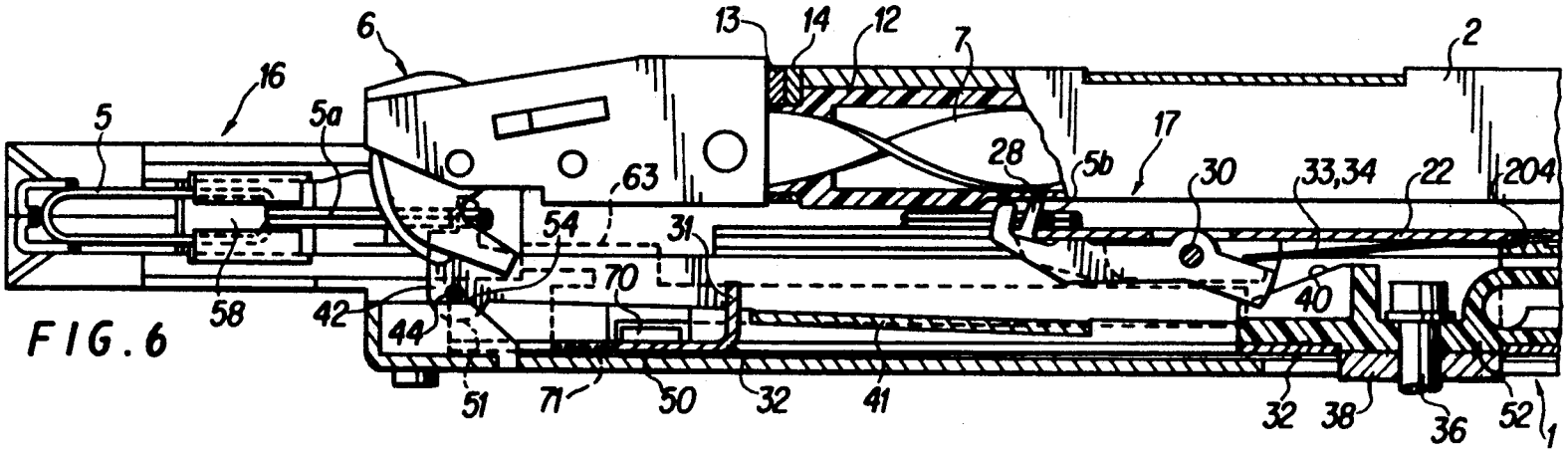
FIG. 6 shows a sectional view taken along the line VI—VI of FIG. 3.
Figure 7:
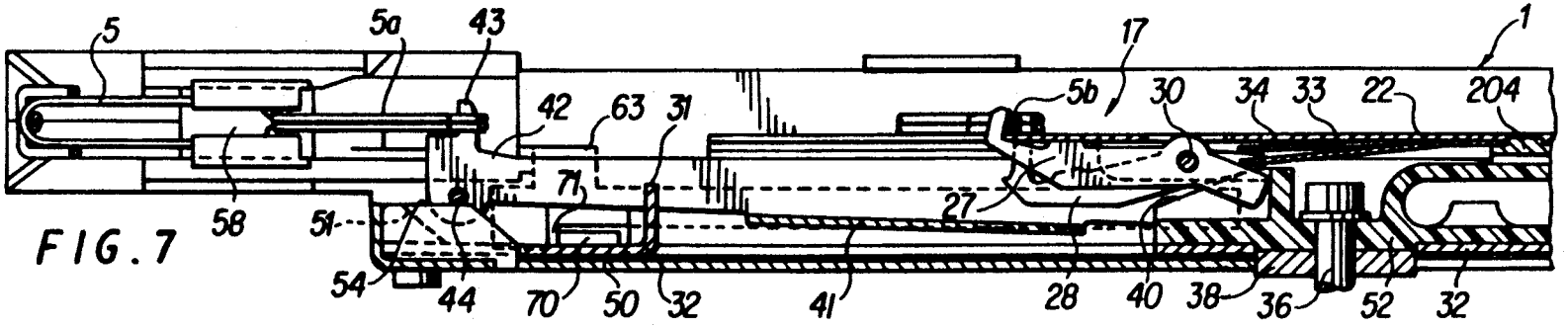
FIG. 7 shows a sectional view taken along the line VII—VII of FIG. 4.

The binding hook 6, which is illustrated on an enlarged scale in FIG. 6, is detailedly described in the European Patent Publication no. 343 309. and has such a configuration that it is automatically released during the retraction movement if twisting of the wire clamp loop has been sufficiently effected. Knurled rod 7 and binding hook 6 are drawn back to their initial position by means of two rolled springs 8 each of which is held by a hub 9. For better resilience, respectively shock absorption during retraction of the hook, three discontinuous tubular pieces 10 are disposed on the hub. Knurled rod 7 extends in an upwardly incised and covered guiding tube 11, and its forward portion runs in a plastics spindle bearing 12. In order to absorb the shocks of the rod during retraction by the rolled springs, housing portion 2 is further provided with a buffer plate 13 and a plastics damping plate 14.

Figure 10:
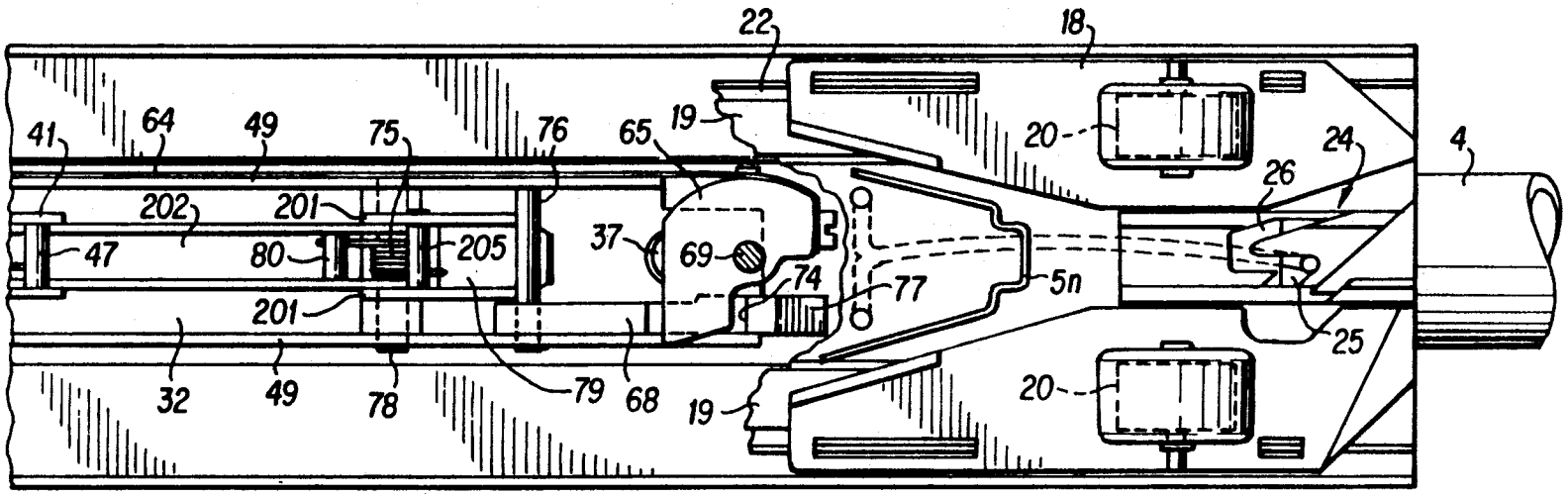
FIG. 10 shows a further enlarged detail of FIG. 1.
Figure 12:
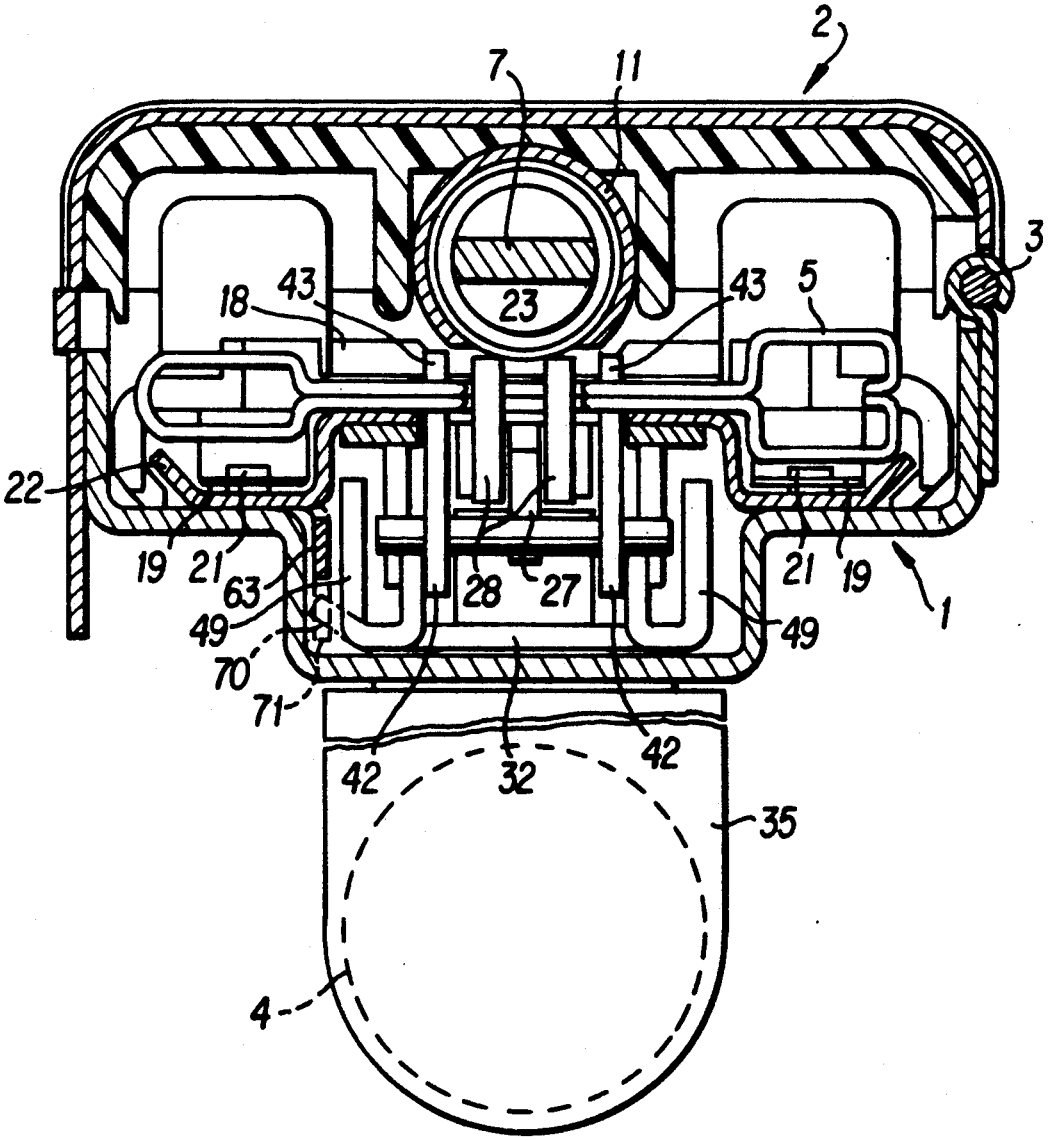
FIG. 12 shows a cross-section through the closed apparatus.
Figure 13:
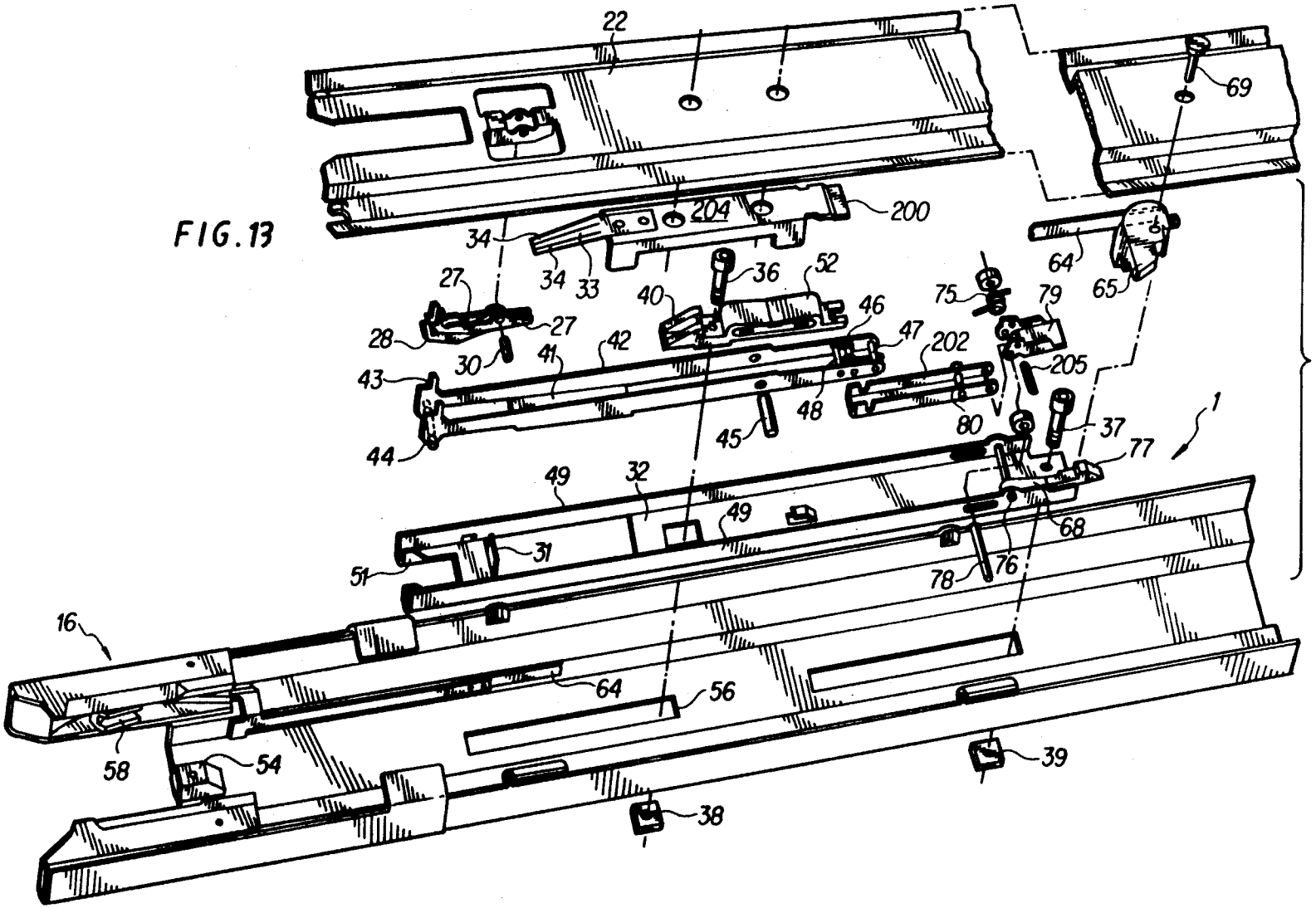
FIG. 13 shows an exploded perspective view of the invention.
Figure 14:
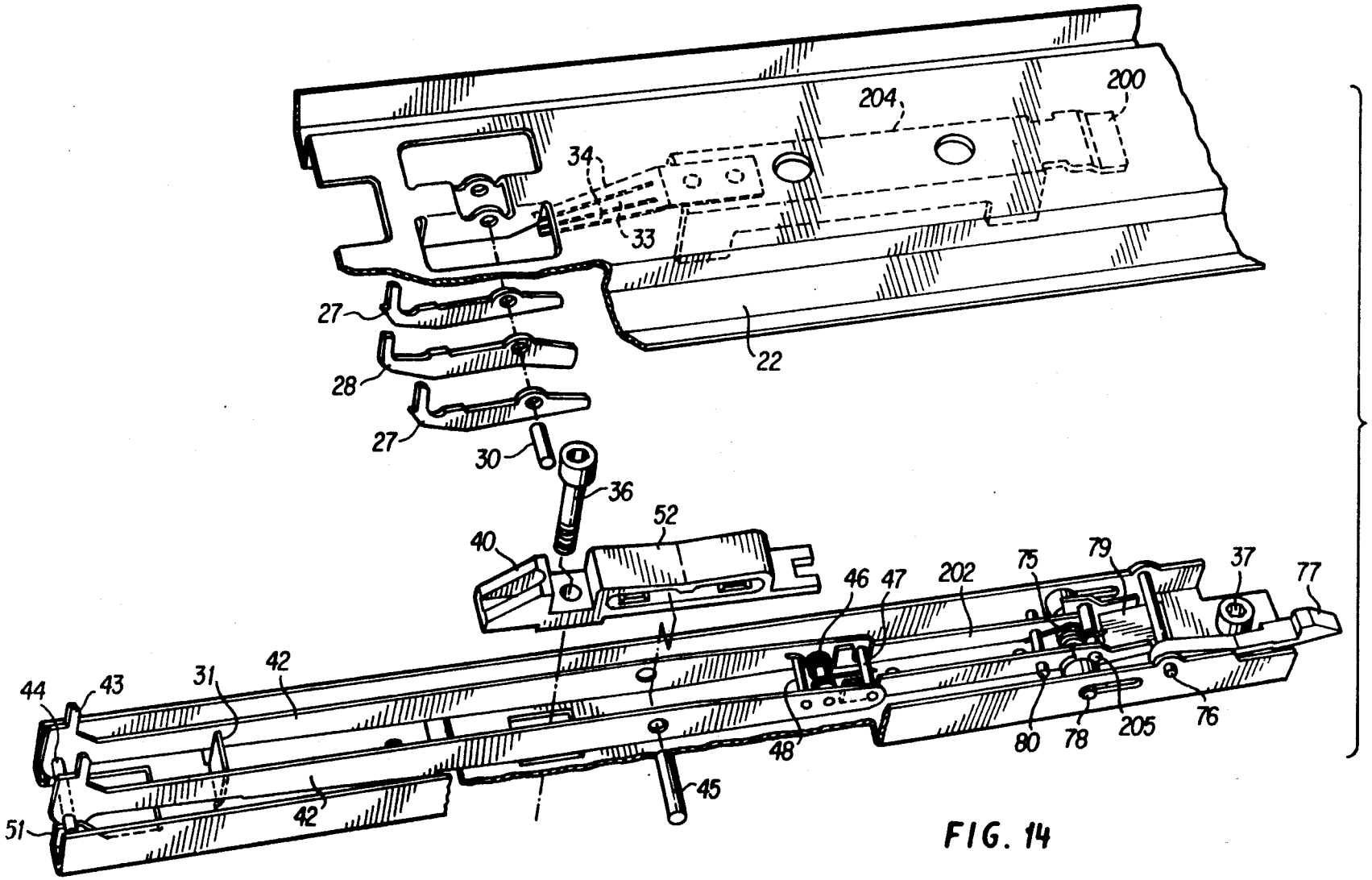
FIG. 14 shows another exploded perspective view of the invention.

As mentioned above, the present apparatus has been modified in many details, as compared to the above-mentioned embodiments of the previously cited application, in order to improve its reliability. The principle of the embodiment having rigid closing jaws 15 and 16 as well as a bending pin disposed in the closing jaw 16 has been retained, said bending pin serving the purpose of achieving a better engagement of the wire clamp locking means, as will appear from the following drawings. Housing portion 1, which serves as a magazine at the same time, is intended for a stack of wire clamps 5 to 5*n*, only the first wire clamp 5 and the last wire clamp 5*n* being illustrated in FIG. 1, and these wire clamps being detachably tacked together. Upon insertion, the foremost wire clamp 5 is held by a retaining device 17 consisting of pawls, this device effecting individualisation of the wire clamps, too. The wire clamps are pushed forward, i.e to the left in the drawing, by a stack slide 18 having a V-shaped cutout on one side which is in turn advanced by means of two rolled springs 19 which are secured to hubs 20. The two rolled springs are suspended on hooks 21 at the front. The wire clamps rest on a cover 22 serving as a stack support, the shape of which appears in FIG. 12. It is important in this connection that the stack is guided on a relatively wide surface in the center. On the opposite side, the stack is guided by the longitudinally slit portion 23 of guiding tube 11. Stack slide 18 is provided with a device 24 which holds it in a resting position during loading and releases the stack slide after insertion of the wire clamp stack in order to advance the stack. This device may be formed of an upwardly bent pin of plastics material, for example, which engages either in the shorter channel 25, to retain the stack slide, or in the other channel 26, whereby the stack slide is released (FIG. 10). Changeover is effected by retracting the stack slide. Different known retaining and release devices may also be used, however.

Figure 5:
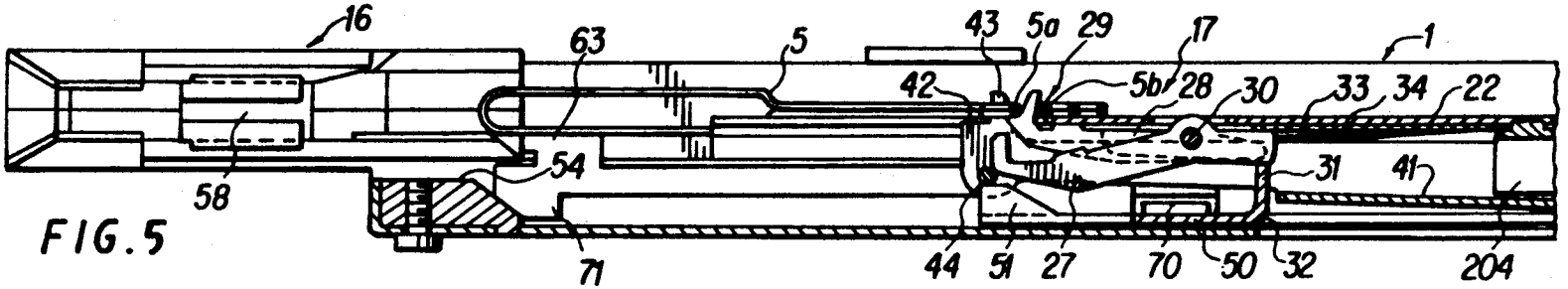
FIG. 5 shows a sectional view taken along the line V—V of FIG. 2.
Figure 8:
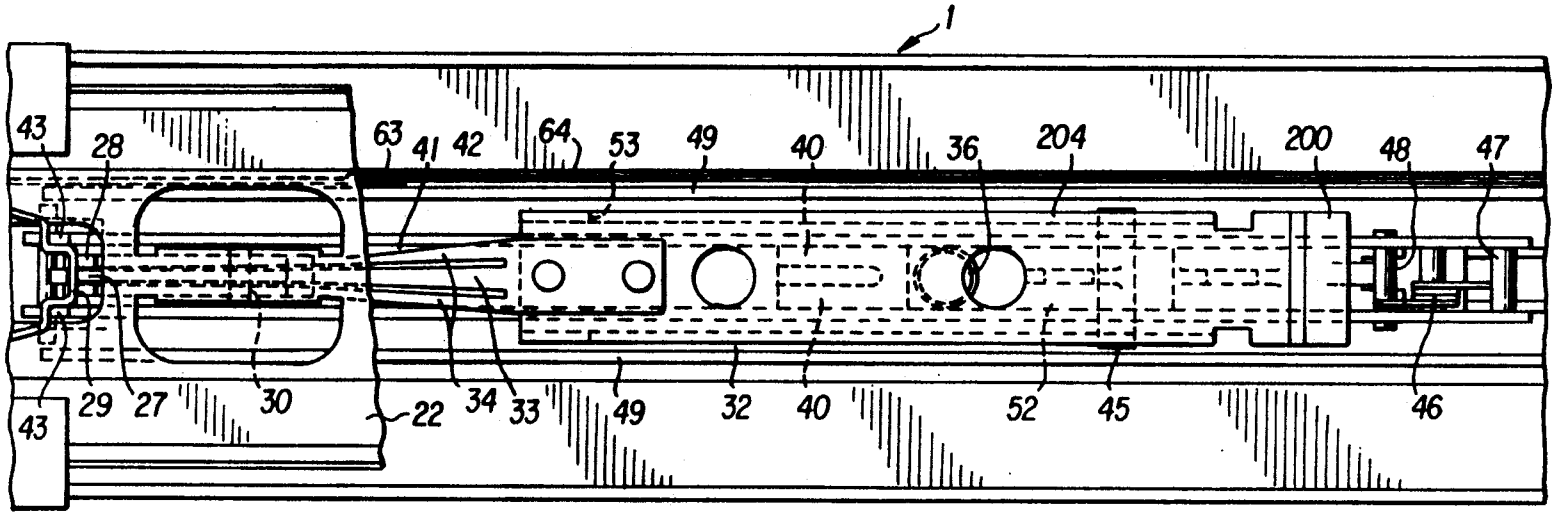
FIG. 8 shows another enlarged detail of FIG. 1.

Important conditions for reliable operation of the apparatus are a safe individualisation of the wire clamps from the stack, as well as positive engagement of the locking means of the wire clamp, so that the locking means do not open during the pulling movement which twists the loop of the wire clamp. Operation of these particular parts is described herebelow. The retaining and advancing device 17 is described first. In FIG. 5, this device is represented in its initial position, i.e. after loading and after a loading movement has been carried out. Retaining device 17 is formed of a central retaining pawl 27 and two surrounding retaining pawls 28, the central and outer retaining pawls alternatingly engaging the wire clamp crosspiece 29 (see also FIG. 8), as appears in FIGS. 5 7, 13 and 14. The central retaining pawl is only operative when the outer retaining pawls are directed under the foremost wire clamp, in order to engage the crosspiece or apex of the second wire clamp. During that time, the spring-loaded clamp stack has to be retained, which is achieved by the central retaining pawl. Both the two outer retaining pawls 28 and the central retaining pawl 27 are hinged on an axle 30. In the position of FIG. 5, the central retaining pawl 27 is depressed by a tab 31 of sliding plate 32, so that only the two outer retaining pawls 28 engage the transitional portion of the second wire clamp and retain the entire stack. Both the central and the outer retaining pawls are urged upwards by means of springs 33 and 34.

A very important element of the present apparatus is sliding plate 32, which provides for individualization of the wire clamps and positive engagement of the two locking members of the wire clamp by its different parts that are going to be further explained. It is well visible in FIGS. 9 and 11 that the mounting support 35 for handle 4 is rigidly secured to sliding plate 32 by securing bolts 36 in FIG. 9 and 37 in FIG. 11, suitable sliding guides 38 and 39 being provided on the sliding plate. Two inclined surfaces 40 are disposed near the holding member 38, which act upon the rearward portions of the outer pawls 28 and depress these, when the sliding plate is advanced (see FIG. 7), while the inner pawl 27 is lifted by spring 33 in the position of FIG. 7. When the handle is retracted, i.e. when the inclined surfaces 40 no longer act upon the outer pawls 28, these are lifted by springs 34. After individualisation, the particular foremost wire clamp has to be advanced through the closing jaws, which is achieved by the slide 41 consisting of two shanks 42, each shank being provided with a projection 43 which engages the shoulder portion of the wire clamp. The two slide shanks 42 are connected by a bolt 44 which projects a few millimeters on both sides. Slide 41 is pivotably beared on axle 45 which also serves as a stop, as will be explained below. A spring 46 acts upon the rearmost portion of slide 41 and actuates an axle 47 on the slide shanks 42 in order to lift the rearward portion of the slide and to depress projections 43 in the front section of the slide, respectively. On the other side, spring 46 bears against spring guiding bolt 48.

Figure 9:
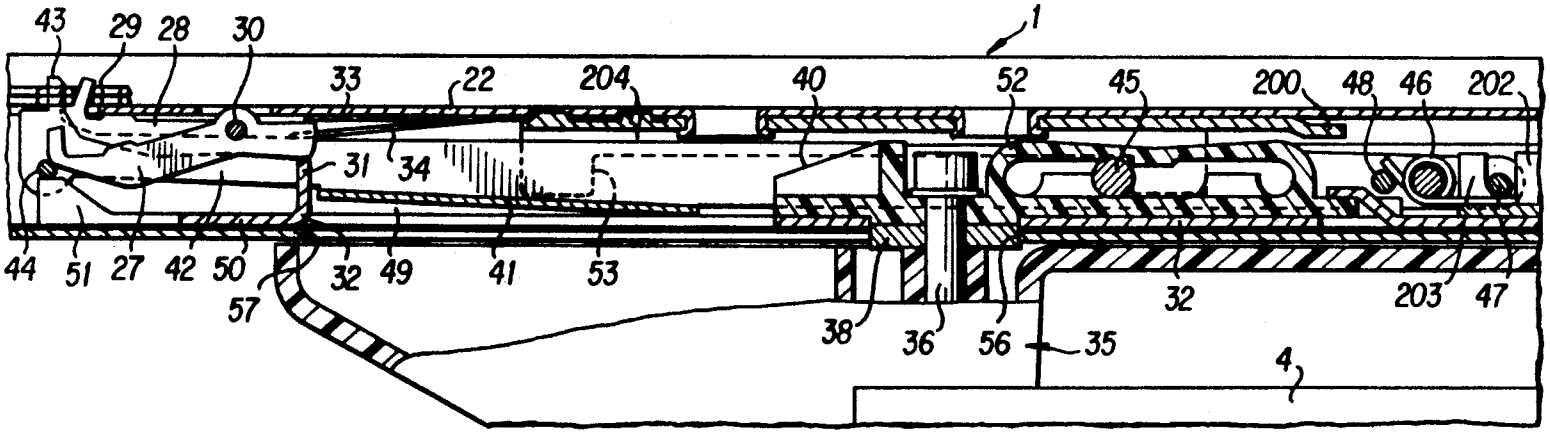
FIG. 9 shows a longitudinal section of FIG. 8.
Figure 11:
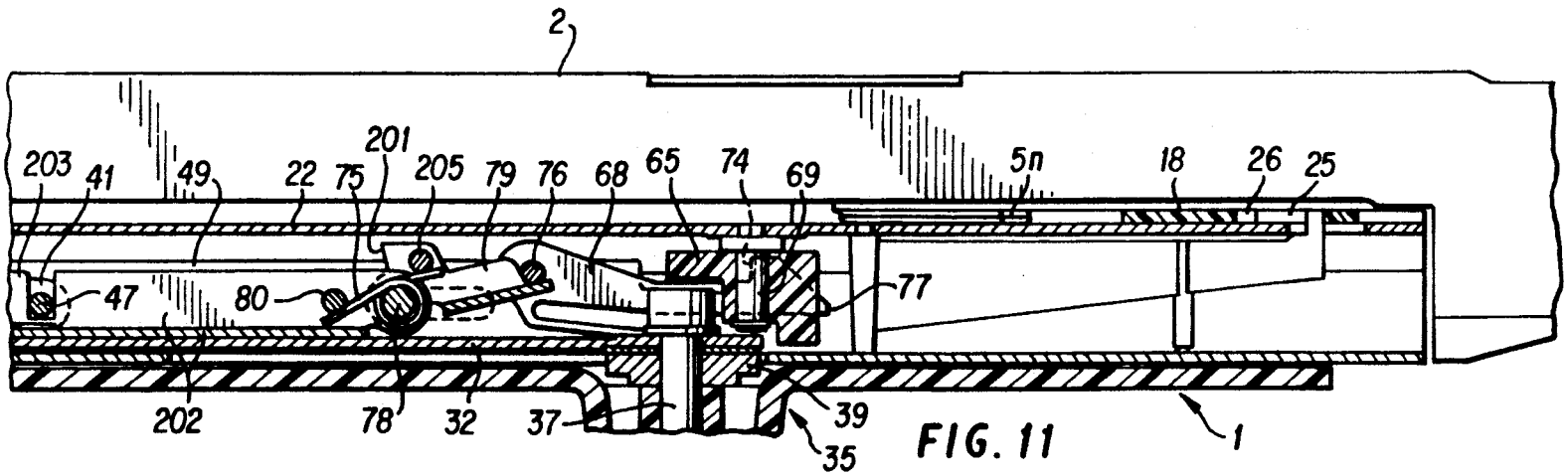
FIG. 11 shows a longitudinal section of FIG. 10.
Figure 15:
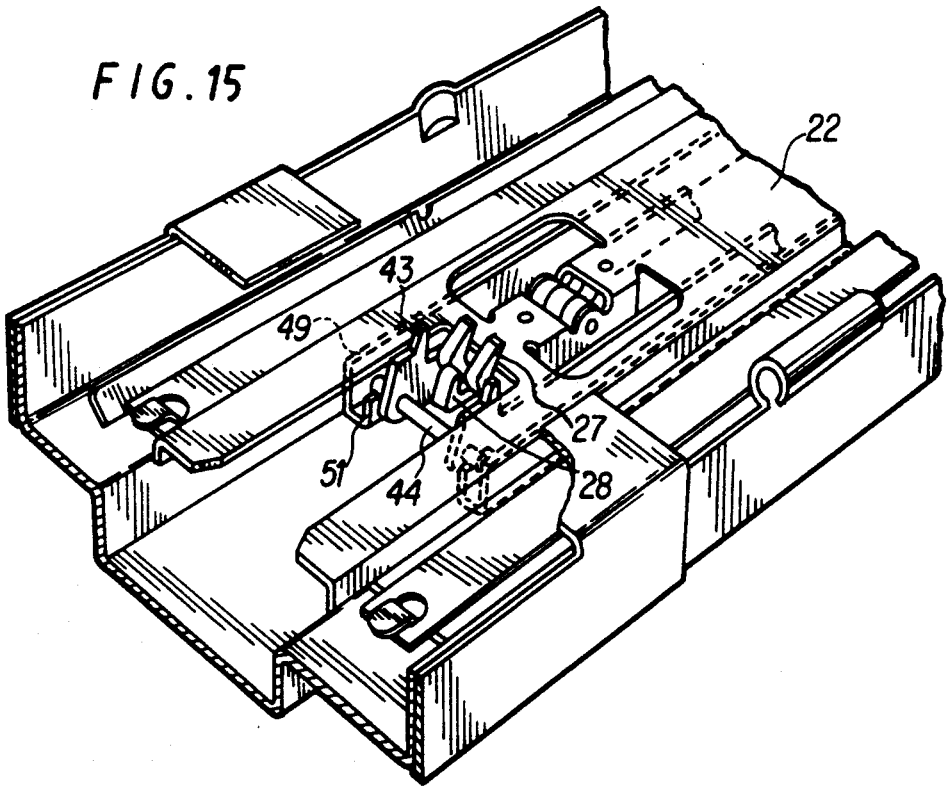
FIG. 15 shows a perspective view of the front portion of the invention.
Figure 16:
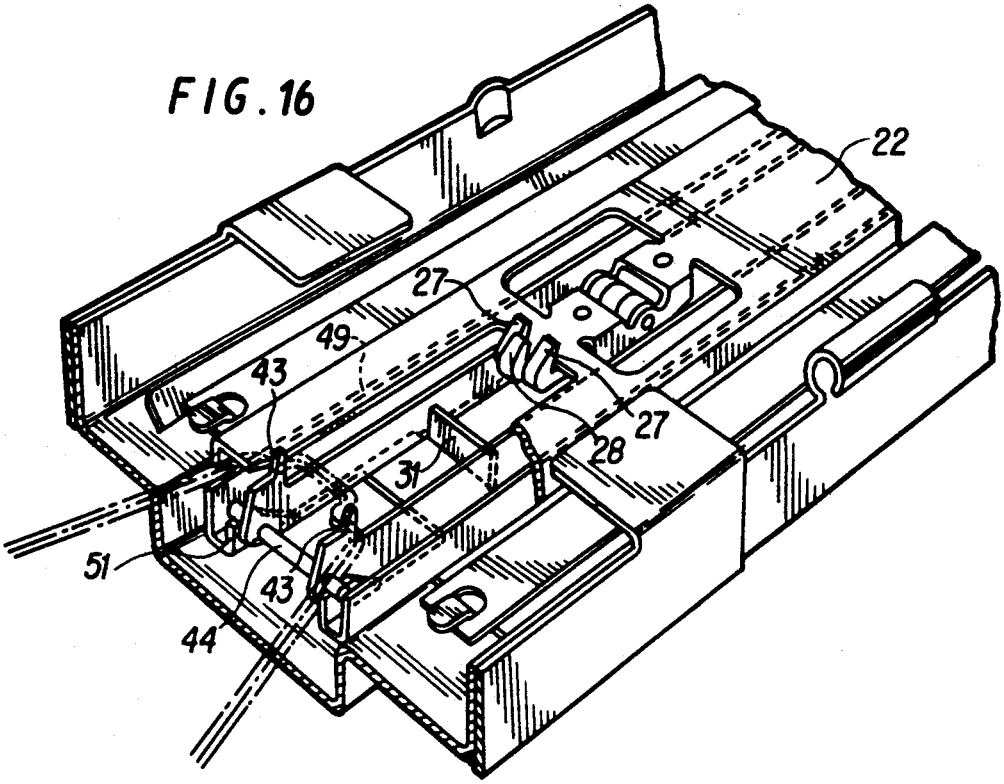
FIG. 16 shows another perspective view of the front portion of the invention.

Slide 41 is coupled to sliding plate 32 by means of its bolt 44. Sliding plate 32 is provided with two parallelly extending sliding plate shanks 49 on each front portion of which, i.e. towards the closing jaw end, a respective guiding plate 50 is disposed having each a respective inclined surface or vertical projection 51 on both sides (see FIGS. 9, 15 and 16). Inclined surfaces 51 control the two positions of projections 43, either lifted and in engagement, as in FIG. 9, or, during the retraction movement, in the depressed position and extending below the wire clamp. The slide is guided in the sliding plate not only by means of bolt 44, but also by its pivot axle 45 which is journalled in the control member 52 connected to sliding plate 32. Force transmission from sliding plate 32 to slide 41 is largely effected by axle 76 which is secured in the sliding plate shanks 49 and which bears upon a locking pawl 79 which in turn is pivotably secured to locking pawl axle 78 (see FIG. 11). Locking pawl axle 78 is secured in an U-shaped bail 202 which is lengthwise displaceably guided between sliding plate shanks 49 and the front ends of which have the configuration of hooks 203 connected with axle 47 at the rear end of slide 41. In the position of FIG. 11, axle 76 acts upon locking pawl 79 and thereby upon slide 41. Locking pawl 79 is under pressure of a spring 75 which is supported by axle 205 mounted in the pawl and bears against spring bearing bolt 80. In the position shown in FIG. 9, the apparatus is in its initial position, i.e. the two outer retaining pawls 28 retain the second wire clamp 5*b* by its transitional portion 29, while the two projections 43 of the slide advance the foremost wire clamp 5*a*. During this movement, sliding plate 32 and slide 41 are coupled. When the position according to FIG. 6 is attained, slide 41 cannot proceed as the two ends of its axle 45 run against the front stop 53 of stop member 204 on the left in FIG. 9. As yet, slide 41 has been locked rigidly with sliding plate 32 by means of U-shaped bail 202 and pawl 79 in order to provide forced advance of wire clamp 5. Just before contact of axle 45 with stop 53, shoulder 201 of pawl 79 runs against stop edge 200 of stop member 204 (see FIG. 9), whereby pawl 79 is depressed and consequently, slide 41 is unlocked from sliding plate 32 which then can travel the remaining distance. Thereby, bolt 44 slides onto shoulder 54 and rests thereon during the subsequent 9 mm movement of sliding plate 32. During this 9 mm movement the control piece 52 also keeps moving, said control piece having such a configuration that it acts as a spring, respectively clamp for axle 45. During the following retraction movement, the slide drops upon inclined surfaces 51 under the action of spring 46, and projections 43 of slide 41 pass underneath the following wire clamp. At the end of the retraction movement, as bolt 44 runs on inclined surfaces 51 and lifts the slide back to its initial position as shown in FIG. 9, pawl 79 is brought back into engagement with bolt 76 by spring 75. Besides, FIG. 9 shows the entire stroke of the handle, respectively the sliding plate, i.e. between the rearward stop 56 and the front stop 57 of housing portion 1.

Figure 4:
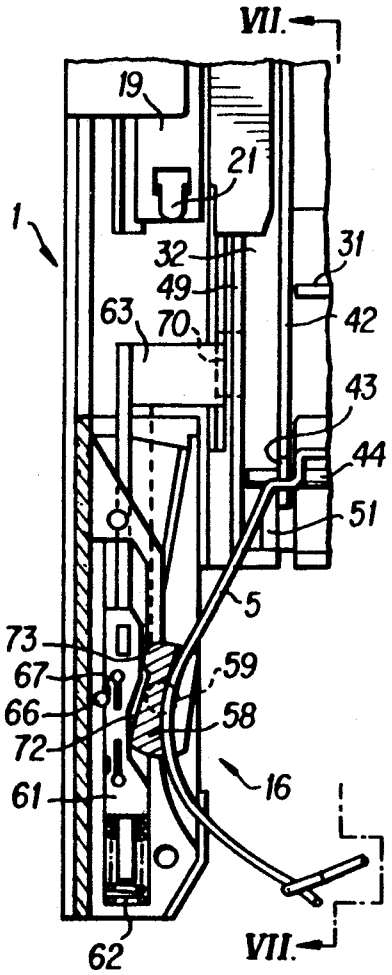
FIGS. 2 to 4 show three operational phases of the apparatus in an enlarged detail of FIG. 1, only one half being shown in FIG. 4.
Figure 3:
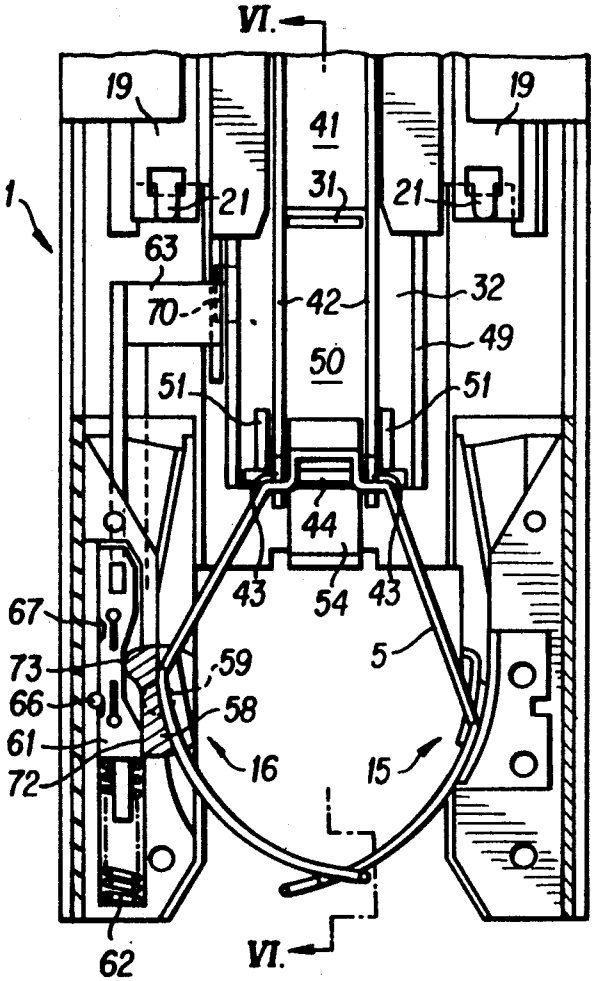
Figure 2:
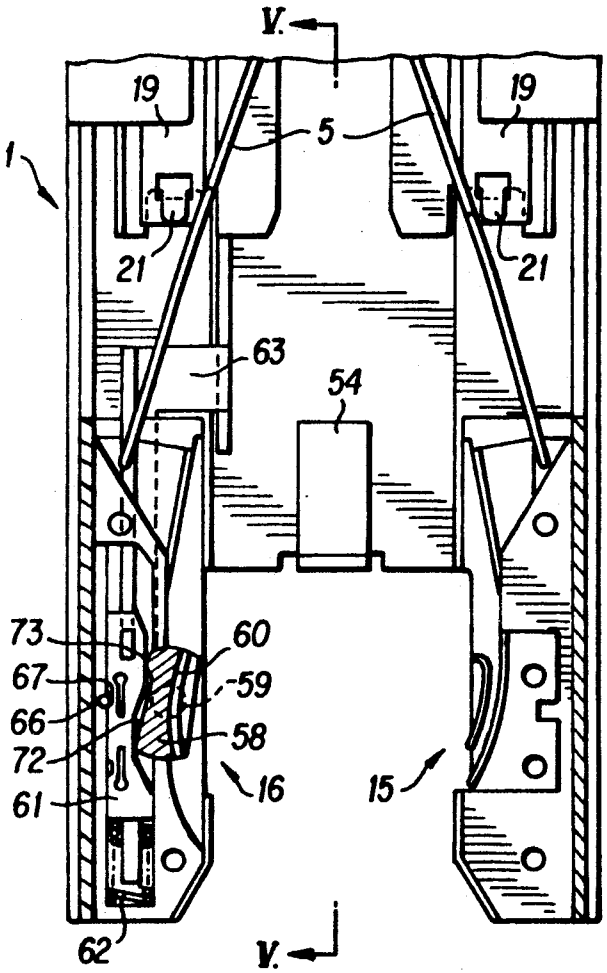

Sliding plate 32 not only serves to control individualisation as well as advance and engagement of the wire clamps, but also to secure positive engagement of the wire clamp locking means in such a manner that these connecting means cannot be disengaged during the following twisting of the wire. This safety, which is illustrated in FIG. 4, is achieved by a bending pin 58 which has already been disclosed in a similar form by the previously mentioned document. In that case, however, the bending pin was controlled by a pawl device, whereas in the present invention, it is controlled by the sliding plate, namely during the additional advance of this sliding plate, i.e. the additional 9 mm. Bending pin 58 is pivotably beared on its axle 59 and comprises a curved channel 60 for guiding the wire. A cam slide 61 under pressure of a spring 62 is lengthwise displaceably disposed in the closing jaw 16. According to FIG. 2, the bending pin is held, against the spring pressure, in a position which corresponds to that of securing the locking means of the wire clamp according to FIG. 4. Cam slide 61 is linked by a connecting slide 63 and a traction bend 64 to a pivot piece (see FIGS. 10 and 11) 65. In the initial position of FIG. 2, the cam slide is only subjected to the pressure of pressure spring 62 and held by pin 66 engaging rearward notch 67 of the cam slide. As the handle, respectively the sliding plate, is advanced, a spring level 68 engages the end of pivot piece 65 and pivots the latter around its axle 69, whereby traction band 64 is stretched. This additional traction force, which is added to the force of pressure spring 62, results in disengagement of the rearward cam slide notch and forces the cam to slide backwards, i.e. to the left in the drawing and into the position shown in FIG. 3, thus urging the bending pin 58 into such a position that the wire clamp may pass into bending pin channel 60. As the sliding plate is displaced by the remaining 9 mm, an abutment 70 disposed on the corresponding sliding plate shank engages shoulder 71 of the connecting slide and forces said connecting slide and thereby cam slide 61 forward, surface 72 engaging cam 73 of the bending pin and urging it into the position of FIG. 4, so that the wire clamp shank shown on the left in the drawings is bent to the left-hand side in order to positively engage its locking means. Notch 67 thereby catches with bolt 66, so that the cam slide and consequently the bending pin remain in the position shown in FIGS. 2 or 4 when the handle is retracted together with the sliding plate.

The movement of the siding plate acting upon the cam slide via the connecting slide actuates pivot piece 65 by traction band 64 in order to return it to the position of FIG. 10. As already mentioned above, the thrust movement brings about rotation of the pivot piece by the edge 74 of spring lever 68 connected to the sliding plate, whereas the projection of the lever passes underneath pivot piece 65 when the sliding plate is retracted together with lever 68.

This results in the following sequence of operation: After opening the two housing portions and retracting the stack slide to its locked position, the stack consisting of tacked wire clamps is inserted in the correct position, and the stack slide is advanced from the locked position towards the handle end and released, so that the stack slide bears on the stack and urges it forward. Then a loading movement is effected by pulling the handle back to the stop, advancing it to the forward stop, and retracting it again in order to load the apparatus. In the meantime, the central retaining pawl first holds back the entire stack, while the outer two retaining pawls 28 pass underneath the first clamp and then retain the second clamp of the stack by its transitional portion, and the two projections of slide 42 engage the two shoulders of the foremost clamp. By a thrust movement, the foremost wire clamp is now detached from the stack and advanced, the bending pin in one of the closing jaws reaching the correct position for reception of the wire clamp shank and the two wire clamp shanks being bent together in such a manner that their locking means become engaged. By pressing down the sliding plate and thus the connecting slide completely, the bending pin is pivoted outwardly after release of slide 41 in order to positively interlock the locking means of the wire clamp. In this position, the uppermost portion of the wire clamp is caught in binding hook 6 fitted on knurled rod 7, such that the binding hook performs a rotational movement and twists the upper loop of the wire clamp upon retraction of the entire apparatus. During the retraction movement, the two projections 43 of slide 41 pass under the now foremost wire clamp and are lifted back at the end of the retraction movement, while simultaneously the outer retaining pawls 28 also pass under the foremost wire clamp and are lifted up behind its transitional portion, the central retaining pawl 27 no longer engaging the transitional portion of the wire clamp. The sequence of operation may thus start over again.

As has been mentioned at the very beginning of the description, it is advantageous to use a self-releasing binding hook as described in European Patent Publication no. 343,309, such binding hook being released by the contraction of the loop and thus allowing removal of the hook from the formed wire clamp loop.

The described apparatus is designed for maximum reliability under all conditions of a construction site in order to obtain fast and effortless operation.

What we claim is:

1. An apparatus for binding at least two rods, comprising:

a housing having a front and a back portion;

means, connected to the back portion of said housing, for activating said apparatus;

transport means for transporting a plurality of clamps from the back portion to the front portion of said housing, each clamp in said plurality of clamps having an apex and a pair of leg members with complimentary locking means extending from said apex;

selection means for selecting a clamp from said plurality of clamps brought forward by said transport means, said selection means positioned in said front portion of said housing;

closure means for joining said complimentary locking means of said clamp chosen by said selection means, said closure means located in front of said selection means;

a sliding plate comprising first and second lateral shanks extending along said sliding plate, and a plurality of vertical projections located on a front end of, and disposed around a longitudinal axis through said sliding plate, said sliding plate and vertical projections cooperating with said selection means in selecting said clamp and said first shank cooperating with said closure means inclosing said clamp; and grabbing means for seizing and twisting said clamp to secure said rods together, said grabbing means located within said closure means.

2. An apparatus as in claim 1, wherein said first lateral shank of said sliding plate has a top and an abutment on said top for cooperating with said closure means.

3. An apparatus as in claim 1, wherein said apparatus further comprises a longitudinal axis, said rods are positioned within said closure means and said closure means comprises;

a pivotable bending pin adjacent to said rods;

slide means for pivoting said bending pin, said slide means located between and cooperating with said sliding plate and said bending pin, and moveable in a direction substantially parallel to said longitudinal axis; and spring means for causing said slide means to move in said direction when said means for activating is activated, said spring means extending from the back portion to and including the front portion of said housing.

4. An apparatus as in claim 3, wherein said slide means further comprises a rod with a top and an end, a first plate on said rod end and a second plate with a lateral notch on said rod top, and said apparatus further comprises a bolt adjacent to said second plate which cooperates with said notch, whereby said bolt and notch prevent said spring means from moving said slide means until said means for activating is activated.

5. An apparatus as in claim 4, wherein said bending pin has a top face and a guiding channel for guiding said clamp in said top face of said bending pin.

6. An apparatus as in claim 1, wherein said transport means, selection means and closure means are located in a first housing part and said grabbing means is located in a second housing part, said first housing part having a longitudinal axis.

7. An apparatus as in claim 6, wherein said first housing part and said second housing part are connected by hinges.

8. An apparatus as in claim 6, wherein said grabbing means further comprises a knurled rod with an end and a binding hook connected to said knurled rod at said end.

9. An apparatus as in claim 7, wherein said first housing part and said second housing part can be locked together by means of a lock.

10. An apparatus as in claim 6, wherein said first housing part further comprises a cover positioned on top of said first housing part.

11. An apparatus as in claim 10, wherein said transport means further comprises a stack slide disposed on said cover for moving said stack of clamps along the longitudinal axis of said first housing part.

12. An apparatus as in claim 11, wherein said transport means further comprises two hubs located proximate to said means for activating in said back portion of said housing, two hooks located in said front portion of said housing and two rolled springs suspended on said hooks and secured to said hubs and cooperating with said stack slide, whereby said rolled springs cause said stack slide to move forward into said front portion of said housing.

13. An apparatus as in claim 12, wherein said stack slide has a front and back section, said back section of said stack slide having a cutout and said transport means further comprises a flexible arm for securing and releasing said transport means, said flexible arm having a joined end and a free end, said joined end connected to said back portion of said housing and said free end connected to a pin which cooperates with said cutout in said stack slide.

14. An apparatus as in claim 13, wherein said front section of said stack slide has a V-shaped cutout for engaging said plurality of clamps.

15. An apparatus as in claim 14, wherein said pin is manufactured from a plastic material.

16. An apparatus as in claim 1, wherein said means for activating comprises an activatable handle.

17. An apparatus as in claim 1, wherein said apparatus has a bottom portion and further comprises a means for mounting said apparatus positioned along said bottom portion of said apparatus, said means for mounting being rigidly secured to said sliding plate.

18. An apparatus as in claim 1, wherein said sliding plate has a back section and further comprises a hollow control housing located on said sliding plate in said back section of said sliding plate which cooperates with said closure means.

19. An apparatus as in claim 18, wherein said closure means further comprises a slide having lateral sides, slide shanks having front and back ends and located along said lateral sides of said slide, said front ends of said slide shanks projecting beyond said slide itself, a connector for connecting said front ends of said slide shanks, and an axle connecting said back ends of said slide shanks, said axle being journaled in said control housing.

20. An apparatus as in claim 19, wherein said connector is a bolt.

21. An apparatus as in claim 19, wherein said slide has a front and a back end, said front end of said slide being higher than said back end of said slide.

22. An apparatus as in claim 19, wherein said slide has a back end, said sliding plate shanks have ends, and said apparatus further comprises connection means for engaging said sliding plate with said slide, said connection means located on the back end of said slide and the ends of said sliding plate shanks.

23. An apparatus as in claim 22, wherein said apparatus further comprises extension means for disengaging said slide from said sliding plate and permitting said slide to move forward, said extension means located at said ends of said sliding plate shanks, behind said connection means.

24. An apparatus as in claim 21, wherein said selection means further comprises individualization means for separating one clamp from said plurality of clamps and clamp movement means for moving said one clamp to said closure means, said individualization and clamp movement means located along said longitudinal axis of said first housing part.

25. An apparatus as in claim 24, wherein said selection means further comprises a vertically projecting tab for triggering said individualization means, said tab located on said sliding plate between said slide shanks and in front of said slide.

26. An apparatus as in claim 25, wherein each clamp of said plurality of clamps further comprises a transitional portion located between said apex and said locking means, said sliding plate further comprises a middle portion and an angled extension located in said middle portion of said sliding plate, and said selection means further comprises a central pawl disposed so as to retain said one clamp by its apex and surrounding pawls disposed so as to retain said one clamp by its transitional portion, said central and surrounding pawls located in the front portion of said housing along its longitudinal axis, whereby said central pawl is moved when said tab contacts said central pawl so as to release said one clamp and said surrounding pawls are moved when said angled extension contacts said surrounding pawls so as to release said one clamp, as said sliding plate moves towards the front portion of said housing.

* * * * *